US005967458A

United States Patent [19]

Williams et al.

[11] Patent Number: 5,967,458

[45] Date of Patent: Oct. 19, 1999

[54] SLAVED REFERENCE CONTROL LOOP

[75] Inventors: Darin Williams, Tucson; John J. Clark, Oro Valley, both of Ariz.

[73] Assignee: Hughes Electronics Corporation, El Segungo, Calif.

[21] Appl. No.: 08/873,436

[22] Filed: Jun. 12, 1997

[51] Int. Cl.[6] ..... F41G 7/00

[52] U.S. Cl. ..... 244/3.16; 244/3.19

[58] Field of Search ..... 244/3.16, 3.19, 244/3.11, 3.13; 89/41.05

[56] References Cited

U.S. PATENT DOCUMENTS

| | | | |
|---|---|---|---|
| 2,963,973 | 12/1960 | Estey | 244/3.16 |
| 3,659,494 | 5/1972 | Philbrick et al. | 89/41.05 |
| 4,009,848 | 3/1977 | Albert et al. | 244/3.16 |
| 4,093,154 | 6/1978 | McLean | 244/3.16 |
| 4,570,530 | 2/1986 | Armstrong | 89/41.05 |
| 5,072,890 | 12/1991 | Klaus, Jr. et al. | 244/3.16 |
| 5,368,254 | 11/1994 | Wickholm | 244/3.16 |
| 5,702,068 | 12/1997 | Stoll et al. | 244/3.16 |

*Primary Examiner*—Charles T. Jordan
*Assistant Examiner*—Theresa M. Wesson
*Attorney, Agent, or Firm*—Michael W. Sales

[57] ABSTRACT

A gimballed camera (34) is attached to a moving body (20) so that it can remain pointed at a desired target (28) as the body (20) moves. A gyroscope (38) is attached to the camera (34) so that it may move independently from the camera (34), so that the gyroscope (38) continuously points in one direction while the camera (34) moves relative to the gyroscope (38). Measurement devices determine the positions of the moving body (20) and gyroscope (38) relative to the camera (34). The sum of these measures yields the position of the target relative to the gyroscope (38), which translates to a command to point the gyroscope (38) at the target. The camera (34) is then moved independently to a specified alignment relative to the gyroscope (38).

22 Claims, 3 Drawing Sheets

SLAVED REFERENCE CONTROL LOOP

TECHNICAL DESCRIPTION

This invention relates generally to a gyroscopic-based instrument for tracking an object moving relative to the tracking instrument and, more particularly, to an apparatus and method for isolating the tracking instrument from the motion of a body carrying the instrument and for controlling the tracking instrument by pointing the gyroscope at the object and aligning the instrument with the gyroscope.

BACKGROUND OF THE INVENTION

The various applications for cameras, such as still and motion picture video cameras, continue to proliferate as technological improvements pave the way for ever-increasing uses. Various technological advances have enabled camera designers to continually reduce the size of the camera while maintaining or increasing the resolution at or beyond the resolution provided by many larger, more expensive cameras. The reduction in size of the cameras has consequently lead to several applications in which cameras are installed in one location and operated remotely from another location. Alternatively, cameras may also may be installed and configured to operate autonomously. Such applications often require the camera to track an object moving relative to the camera so that the object remains substantially centered within the field of view of the camera. As the object moves across the field of view, an electronic controller senses displacement of the object from the center of the field of view and generates control commands to displace the camera to maintain the object in proximity to the center of the field of view.

Numerous applications exist which could desirably capitalize upon such functionality. Cameras having such functionality are often employed at sporting or news events to track objects which are difficult for operator-controlled cameras to track smoothly. For example, blimps having cameras are often employed at golf events to track the flight of a golf ball which travel up to and beyond 300 yards when struck during a tee shot. Both the camera and the golf ball may be moving, further complicating maintaining the golf ball in the center of the field of view of the camera.

In other applications, such as defense and military applications, reconnaissance craft or projectiles may include cameras to track and photograph selected objects. Both the reconnaissance craft or projectile and the object may be traveling at rather high speeds and severely maneuvering, complicating maintaining the object within the center of the field of view of the camera. The challenge is to isolate the camera from the motion of the vehicle when continuing to point stably at the target.

Typically, the camera is mounted to the reconnaissance craft or projectile so that the camera case or platform is either rigidly or displaceably mounted to the body of the projectile. If the camera case or platform is rigidly mounted to the body of the projectile, portions of the camera optics are suspended within the case or platform to provide at least two degrees of freedom. If the camera platform is displaceably mounted to the body of the projectile, such as with gimbles, the camera platform moves in at least two degrees of freedom. In order to stabilize the camera and to provide a reference for target motion, a gyroscope is attached to the camera.

There exists several possible arrangements for isolating the camera from the motion of the projectile body. These arrangements include passive stabilization where the angular momentum of a large gyroscope physically stabilizes the platform and active stabilization where a small gyroscope or other device is used to measure inertial stabilization providing feedback to a stabilization loop. Such control arrangements present many difficulties to the control systems for controlling the camera to maintain the object within the center of the field of view of the camera. Either or both the object and the projectile may be moving at substantial rates of speed which require high bandwidth control in order to maintain the object within the center of the field of view. In addition, projectiles typically experience substantial vibration which may be translated to the camera and often requires filtering from the control algorithms for the camera in order to distinguish between movement of the object and vibration transferred through the body of the projectile.

In a typical camera control system, the camera controller inspects the image output by the camera, and a tracker determines an offset of the object with respect to the center of the field of view. This provides the position of the object relative to the axis of the platform or camera and defines the preferred displacement of the platform or camera in order to move the object back into the center of the field of view. In control terms, the offset is input into a tracking loop filter which generates commands in the form of a rate to displace the platform as needed. The rate includes a direction and speed for displacing the camera. The tracking loop typically operates at the same rate as the camera frame rate.

As stated above, the projectile may experience significant vibration which causes apparent displacement of the object from the center of the field of view of the camera. Because vibrations often occur continuously and vary, active stabilization systems include a stabilization loop which operates at a much higher rate than the camera frame rate. The stabilization loop typically receives feedback from a reference gyroscope attached to the camera platform. The gyroscope includes sensing mechanisms which measure the position of the gyroscope relative to the gyroscope case. The controller then generates commands for applying torque to the gyroscope at a particular rate in order to maintain the object within the center of the field of view of the camera.

More specifically, existing systems employ various approaches for maintaining objects within the center of the field of view of the camera and providing a stable platform for the camera. One such system is known as the gyroscope system. This system employs mechanical gyroscopic stabilization for the camera platform. Rather than using a small or reference gyroscope to measure and correct for disturbances, the camera platform itself is rigidly attached to the case of a large gyroscope so that the platform physically resists disturbances. When the effect of the large gyroscope does not overcome the disturbances, the tracking loop portion of the controller generates control commands to the gyroscope to displace the camera platform so that the object returns to the center of the field of view. The gyroscope system does not have a stabilization loop.

Because the tracking loop has only a single loop, the gyroscope is simple and accommodates a high bandwidth, but these benefits are traded-off against weight, power, and platform disturbance considerations. In order to isolate the gyroscope from platform disturbances, the angular momentum of the gyroscope is increased by increasing the spin rate or mass. Increasing the angular momentum, however, requires a corresponding increase in the torque required to displace the camera or platform in order to follow the object moving relative to the platform. Increased torque requires a corresponding increase in power to the torquer, the apparatus for displacing the camera platform. In addition, the platform disturbances occurring in the gyroscope couple missile body motion, such as spring torques, inertial coupling for roll about the field of view (FOV) axis, mass and balance, friction of the platform, and other disturbances, into the tracking loop. The gyroscope system does not completely satisfy the needs of systems requiring high stability and high accuracy LOS rate estimates, particularly where the missile body undergoes severe maneuvers.

In an effort to improve upon the gyroscope, designers turned to a rate platform approach. The rate platform approach does not rely on gyroscopic momentum to maintain the stability of the camera platform. Stability is maintained by sensing the camera or platform rate, comparing the sense rate to the desired rate, and applying a torque to minimize any difference between the sensed and the desired rate. Because the rate platform approach does not require a large gyroscope to maintain stability of the platform, no large angular momentum must be overcome, and the torquer power requirements for displacing the camera platform significantly decreases. The control system for the rate platform approach includes a tracking loop and a stabilization loop. The tracking loop operates at the camera frame update rate in order to determine the desired rate of platform motion. The stabilization loop operates at a much higher update rate and controls the actual rate of platform motion.

Rate platform control approaches, while addressing many deficiencies presented by the gyroscope, also offer various tradeoffs. Because the stabilization control loop is nested within the tracking control loop, the rate platform sacrifices some of the gyroscope bandwidth. Further, platform disturbances are integrated into the control loop twice in the rate platform approach, while platform disturbances are only integrated once into the control loop for the gyroscope. A double integration occurs because the gyroscope does not mechanically stabilize the platform, so that platform disturbances in the form of torques produce angular accelerations rather than angular rates. But the disturbances are measured by the platform rate sensor and cancelled by the stabilization loop. If the rate sensor disturbances are less than the disturbances to the platform, the rate platform approach produces sufficient improvement for a given weight and power.

The typical rate measuring device for the rate platform approach is a small gyroscope. Most platform disturbances do not affect the gyroscope. For example, spring torques that affect the platform do not directly affect the gyroscope because the cables and tubing that generate such disturbances are not attached directly to the gyroscope. The gyroscope simply measures the resultant effect of such disturbances. The effect manifests itself only in a second order coupling through measurement errors.

In initial rate platform implementations, the gyroscope was retained by a spring, and deflection of the spring indicated the case angle, i.e., the angle between the gyroscope axis and an axis of the container of the gyroscope. The case angle indicated the torque applied to the gyroscope. Thus, the stabilization loop was a first order, proportional control loop based on the torque applied to the gyroscope. More recently, the spring attached to the gyroscope has been replaced by an active control loop which measures the gyroscope case angle then determines the torque applied to the gyroscope. Thus, the torque to be applied to the gyroscope determines the rate at which the gyroscope is moving. When the gyroscope moves in order to follow the platform, this provides a measure of the inertial platform rate.

One drawback of the rate platform approach is that it requires three nested loops: (1) an innermost loop displacing the gyroscope to follow the platform, (2) a middle loop which determines the platform rate based on the torque required to follow the platform, and (3) an outermost loop for generating the desired platform motion based on the LOS to the target. The three nested loops limit the bandwidth of the rate platform approach and also require an extra differentiation between the platform disturbances and the feedback measurement, thereby further increasing the effect of noise. Thus, when disturbances displace the platform, the disturbance is sensed as a misalignment between the gyroscope and the platform in the form of case angle. The gyroscope is then displaced to correct this misalignment. The rate commanded to the gyroscope is sensed as a measured platform rate which differs from the commanded platform rate. A torque is then applied to the platform in order to eliminate the difference between the measured and the commanded rate. Because this control loop requires time to process, residual disturbances are fed back into the tracking loop and consequently require correction. This approach is generally considered superior to the gyroscope in many applications because it eliminates the large angular momentum and resultant torquer power required to displace the platform.

A further improvement to the rate platform approach recognizes that the quantification of platform motion is actually the rate command provided to the gyroscope. This approach is described as a forward loop implementation. The forward loop implementation controls the gyroscope directly from the tracking loop and uses the stabilization loop to drive the platform to follow the gyroscope. This eliminates high frequency gyroscopic input and reduces noise because the gyroscope control is removed from the high update rate stabilization loop and moved to the lower rate tracking loop.

The forward loop approach provides varied benefits. First, the three nested loops of the rate platform approach are reduced to two, resulting in a bandwidth increase. Second, because stabilization occurs in accordance with the gyroscope case angle rather than inferred rate measurement, a derivative step is eliminated from the feedback path. This provides both increased bandwidth and reduced noise.

In the forward loop approach, the control loop senses platform disturbances initially as changes in the gyroscope case angle. The stabilization loop corrects this directly by displacing the platform. However, unlike the rate platform approach, disturbances do not directly produce commands to the torquers for displacing the gyroscope. Some indirect coupling does occur because platform motions alter the input to the tracking loop. These residual disturbances must be first sensed and then corrected through the track loop. In order to limit this effect, the gain for the tracking loop is often reduced. Further, while the mechanical coupling of the body rate through the platform into the gyro is essentially negligible, the mechanical coupling still impacts the tracking loop estimates because portions of the tracking loop estimates feed back into the tracking loop.

The above discussed approaches each include one salient feature which also limits the ultimate performance of such systems. In each system, the platform pointing error, the difference between the target LOS and the present platform orientation, drives the track loop. Such a configuration couples body disturbances into the track loop, thereby limiting the overall effectiveness of each control approach.

Thus, it is an object of the present invention to provide a method and apparatus for enabling a camera to track an object moving relative to the camera using a gyroscopic-referenced tracking approach which is independent of platform motion.

It is a further object of the present invention to provide a method and apparatus for enabling a camera to automatically track an object moving relative to the camera by aligning the gyroscope with the object and adjusting the platform to be aligned with the gyroscope.

It is yet a further object of the present invention to provide a method and apparatus for enabling a camera to automatically track an object moving relative to the camera by providing a control system having a tracking loop and a stabilization loop, where the tracking loop displaces a gyroscope to point at the target and a stabilization loop displaces a platform to align with the gyroscope.

SUMMARY OF THE INVENTION

This invention is directed to an apparatus for enabling a projectile to track an object where the object is moving relative to the projectile. The projectile includes a body which is generally defined as the housing for the projectile. A platform or camera is attached to the body and includes a tracking device. The platform attaches to the body to enable relative movement between the body and the platform. A gyroscope attaches to the platform in order to enable relative movement between the gyroscope and the platform. A controller generates control commands to displace the gyroscope and the platform in order to track the object. The controller first displaces the gyroscope to a predetermined orientation in accordance with the position of the object. The controller then generates control commands to displace the platform in order to align the platform to the gyroscope in a predetermined orientation.

Additional objects, features and advantages of the present invention will become apparent from the following description and the appended claims, taken in connection with the accompanying drawings.

BRIEF DESCRIPTION OF THE DRAWINGS

The drawings, which form an integral part of the specification, are to be read in conjunction therewith, and like reference numerals are employed to designate identical components in the various views.

DETAILED DESCRIPTION OF THE INVENTION

Figure 1:
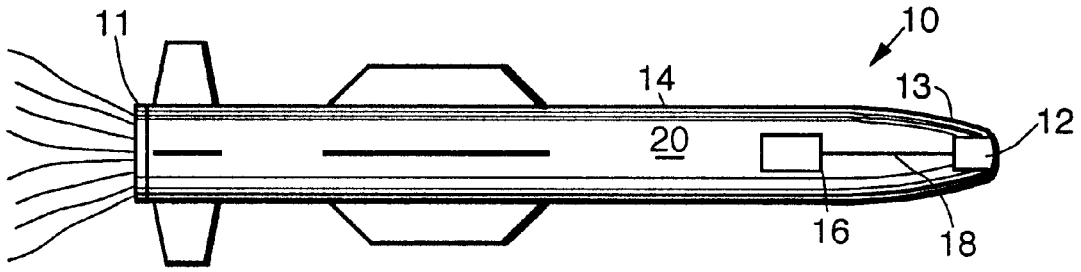
FIG. 1 is a missile having a camera mounted in the head of the missile, where the camera is controlled by a controller in accordance with the principles of the present invention.

FIG. 1 depicts a missile system 10 including a missile 14 having a camera system 12 mounted in the head 13 of the missile 14. The camera system 12 is controlled by a controller 16 which communicates with the camera system 12 via control signals transmitted on control line 18. The missile system 10 also includes a propulsion system 11 for imparting motion to the missile system 10. While the invention is described herein with respect to the missile system 10, one skilled in the art will recognize that the controls for operating camera system 12 have similar application and news cameras, sporting event cameras, and any other camera systems in which it is desirable to track an object moving relative to the camera.

Figure 2:
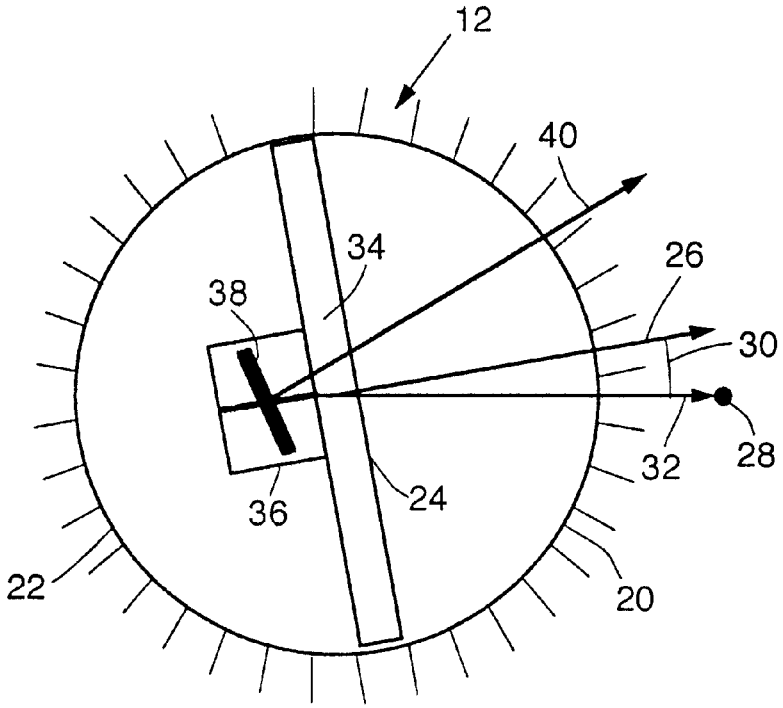
FIG. 2 depicts the mounting configuration for a camera platform controlled in accordance with the principles of the present invention.

FIG. 2 depicts the mounting arrangement for the camera system 12. The camera system 12 is rigidly attached to the body 20 of the missile 14. The camera system 12 includes a gimballed mount 22 which attaches to the body 20 and enables movement in at least two degrees of freedom. The camera system 12 also includes an image plane 24. A platform axis 26 is defined as perpendicular to the image plane 24. The platform axis 26 is aligned with the object 28 to be tracked. When the object 28 is not aligned with the platform axis 26, the angle or error 30 between the platform axis 26 and the actual line of sight (LOS) 32 to the object 28 is referred to as the error 30. The error 30 is measured as an angle as shown in FIG. 2. Rigidly attached to the platform 34 is a gyroscope case 36 which houses a reference gyroscope 38. The reference gyroscope 38 is mounted to the gyroscope case 36 using gimbles (not shown) which enable the gyroscope to spin freely at an arbitrary and changing angle relative to the case. In the operation of conventional gyroscope systems, when the object 28 moves off of the platform axis 26, the platform or camera 34 is displaced to realign the platform axis 26 with the object 28 along the line of sight 32. The gyroscope axis 40 extends perpendicularly to the gyroscope 38 and is aligned with the platform axis 26.

In the system of the present invention, in order to align the platform axis 26 with the object 28 and line of sight 32, a tracker detects the position of the object 28 within the image output by the camera 34. The tracker determines the position of the object 28 relative to the platform axis 26, and thus, describes the desired motion of the platform 34. In the operation of the present invention, the gyroscope 38 is displaced to align the gyroscope axis 40 with the line of sight 32 in order to align the gyroscope 38 perpendicularly to the object 28, causing the gyroscope axis 40 and the line of sight 32 to coincide. In order to align the image plane 24 with the object 28, the platform or camera 34 is displaced to align the platform axis 26 with the gyroscope axis 40, and hence the line of sight 32. In this manner, the gyroscope 38 is aligned with the object 28, and the platform or camera 34 is aligned with the gyroscope 38. In control terms, to be described herein, the tracking loop aligns the gyroscope 38 with the line of sight 32, and the stabilization loop aligns the camera or platform 34 with the gyroscope 38.

Figure 3:
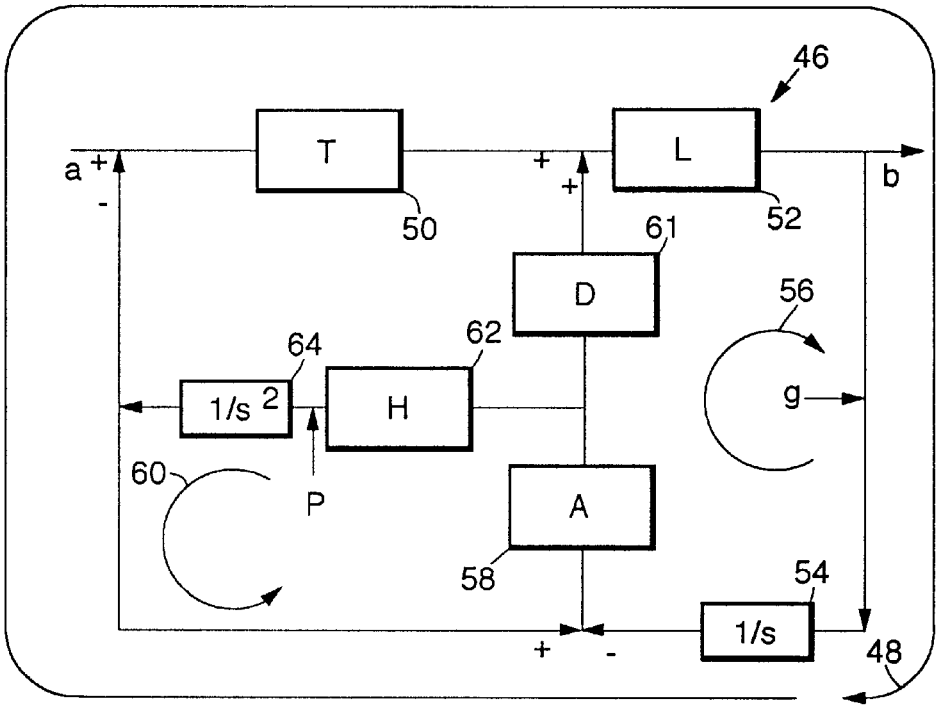
FIG. 3 is a diagram of the control system for implementing the slaved reference loop in accordance with the principles of the present invention.

FIG. 3 depicts a control system for achieving the above-described method of control. The input elements to FIG. 3 are as follows:

| | |
|---|---|
| a | inertial target LOS; |
| g | gyroscope disturbances; and |
| p | platform disturbances (scaled based on sensitivity (p >> g)). |

FIG. 3 also depicts several transfer functions defined as follows:

| | |
|---|---|
| T | tracker transfer function (nominally a fixed delay); |
| D | feedback compensation transfer function; |
| L | low bandwidth tracking loop transfer function; |
| H | high bandwidth stabilization |

-continued

| | |
|---|---|
| | loop transfer function; and |
| A | case angle measurement transfer function (normally one). |

The control loop of FIG. 3 also includes two control blocks depicting a single integrator (1/s) and a double integrator $1/s^2$. The output b for the control system 46 is an approximate LOS rate estimate and is an angle and rate command.

The control system 46 of FIG. 3 includes three control loops. In the first control loop 48, the difference between the target LOS a and the inertial platform position, defined as the platform based pointing error, is input to tracker transfer function block 50. The tracker transfer function block 50 outputs the pointing error measurement. The pointing error measurement and case angle measurement are added and input to track filter or tracking loop transfer function block 52. The tracking loop transfer function block 52 outputs the gyroscope rate command b. The gyroscope disturbances g enter feedback path of first control loop 48. Commands and disturbance torques are applied to the gyroscope, which acts as an integrator 54, resulting in a change in the inertial position of the gyroscope. A second implicit tracking loop 56 utilizes the gyroscope angle relative to the gyroscope case, which is input to case angle transfer function 58. Case angle transfer function 58 outputs a case angle measurement which is input to compensation filter block 61. The case angle measurement is added to the pointing error, creating a gyroscope referenced pointing error as described above, to complete the tracking loop 56. A third loop, the stabilization loop 60, adds the inertial platform position to the inertial gyroscope position to yield the gyroscope angle relative to the case. The gyroscope angle is then input to the case angle transfer function block 58, which outputs the case angle measurement. The case angle measurement is input to stabilization loop transfer function block 62. Platform disturbances p enter the stabilization loop 60. Commands and disturbance torques are applied to the platform, which act as a double integrator 64, resulting in a change in the inertial platform position. The inertial gyroscope position is then subtracted from the inertial platform position to complete the stabilization loop 60. Platform position is also subtracted from the LOS position, completing the outermost track loop 48. The tracking loop 56 receives as input only the pointing errors of gyroscope 38, decoupling the inner track loop 56 from the stabilization loop 60.

Figure 4:
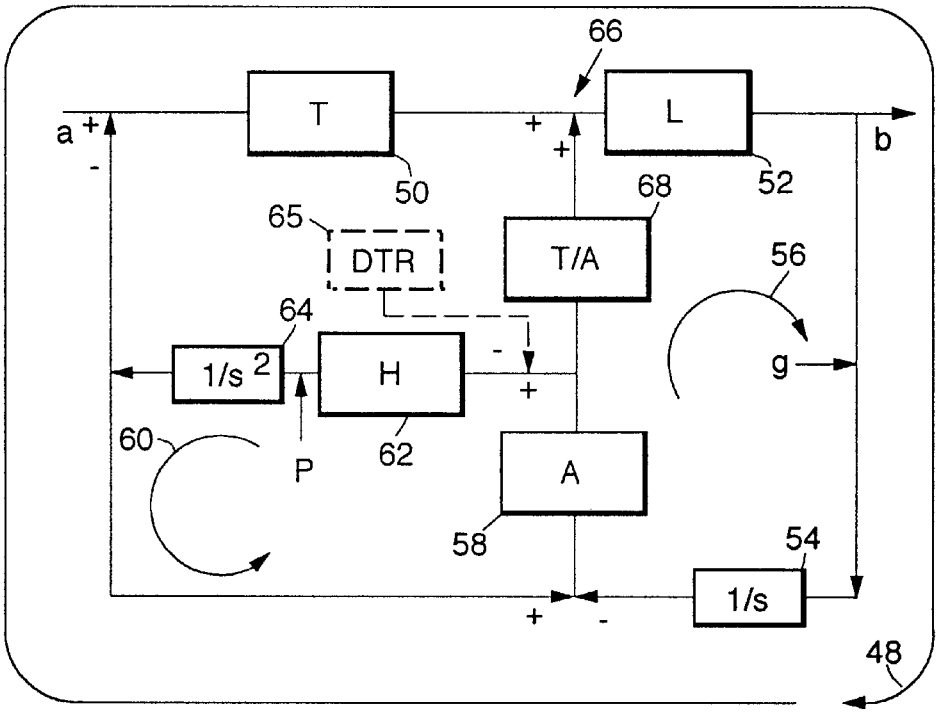
FIG. 4 is a simplified version of the system of FIG. 3 for implementing the slaved reference loop.

FIG. 4 depicts a preferred embodiment to the control system 46 of FIG. 3. In the control system 66 of FIG. 4, similar inputs, outputs, and transfer functions are referred to using similar reference numerals from FIG. 3. The control system 46 of FIG. 3 can be further modified to provide the simpler control system 66 of FIG. 4. Specifically, by setting D=T/A, shown at block 68, only the tracking loop 56 remains. The track filter 52 output is decoupled from the platform motion. Since the tracker and case angle measurement devices are typically well modeled as simple delays at the tracker sample rate, D is reduced to a compensating delay to synchronize the tracker output from T with the case angle measurement from A. As a result, the platform measurements are added and subtracted at the same time so they effectively cancel. This cancels the effects of the outer control loop 48 of control system 46 because the platform position is subtracted before the tracker transfer function block 50 and added afterward through the case angle transfer function block 58. This leaves simply the effect of target motion and the position of the gyroscope. The tracking loop 56 and the stabilization loop 60 are decoupled. As a result, leaving only a single loop configuration, the effect of the track loop 48 is cancelled. When a disturbance displaces the platform or camera 34, the disturbance is sensed as a case angle disturbance, and the platform is adjusted to compensate for this disturbance without altering the input to the track filter 46. Thus, the tracking loop 56 behaves independently from the stabilization loop 60.

The transfer functions for control system 66 of FIG. 4 can be described as follows:

| | I/O | Gyro dist. | Plat. dist. |
|---|---|---|---|
| $T = A = 1;\ D = T/A$ | $\frac{Ls}{L+s}$ | $-\left(\frac{L}{L+s}\right)$ | 0 |
| Arbitrary $T$, $A$ | $\frac{LsT}{s+LT}$ | $-\left(\frac{LT}{s+LT}\right)$ | 0 |

Note from these transfer functions that the I/O response of system 46 no longer depends on the stabilization loop transfer function H so that platform motion does not affect the LOS rate estimate b. The control loop 48 effectively eliminates platform coupling into the LOS rate estimates b used for guidance. The I/O transfer function is independent of the stabilization loop transfer function so that platform disturbances are eliminated from the tracking loop 56.

Figure 5:
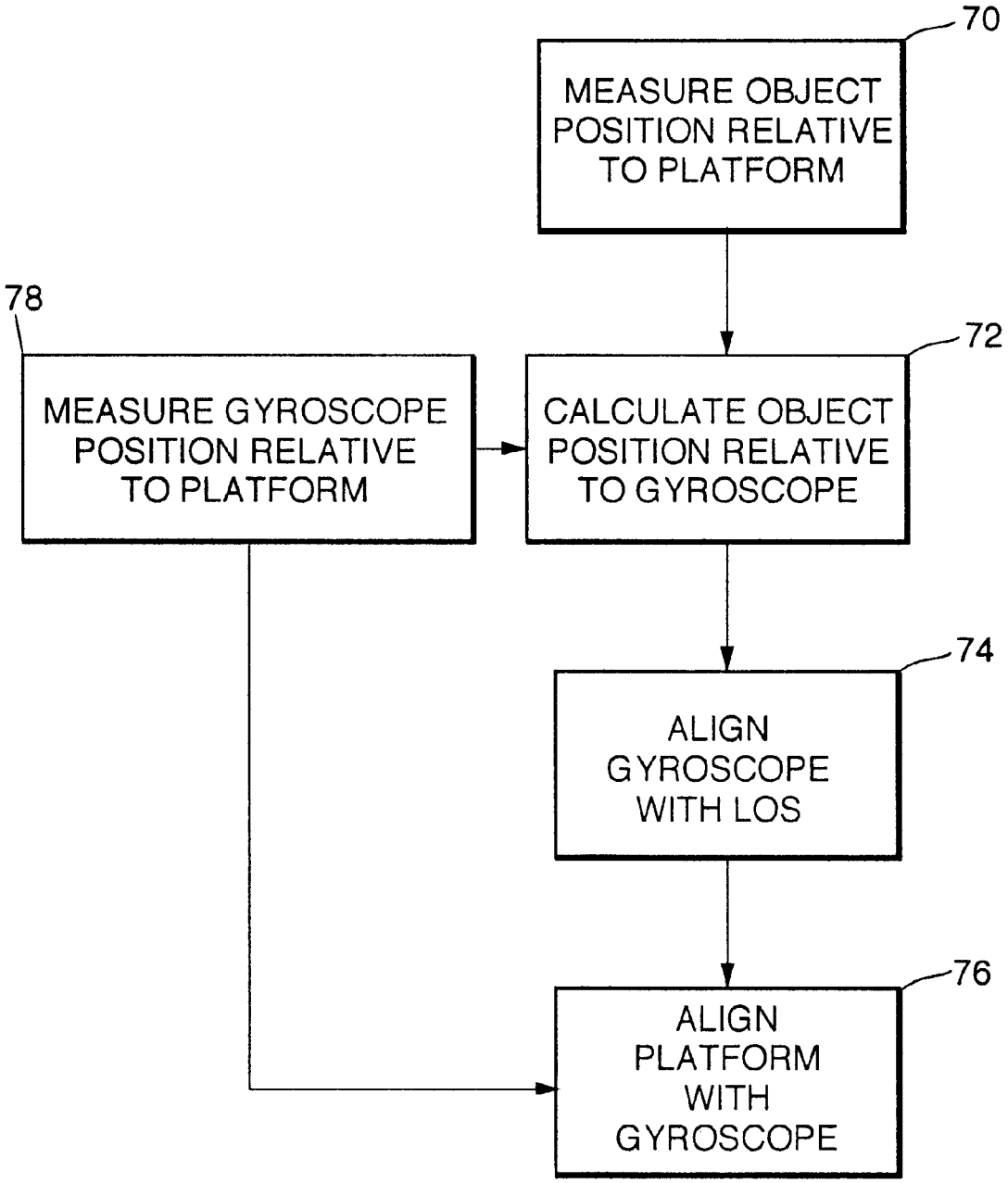
FIG. 5 is a block diagram of the operation of the slaved referenced loop method.

FIG. 5 depicts a flow diagram for the operation of the slaved referenced control loop as shown in FIGS. 3 and 4. Control begins at block 70 in which the image captured by camera 34 is interrogated in order to locate the object or target 28 within the image. Once the object is found, the position of the object relative to the platform is measured. At block 78, the position of the gyroscope relative to the platform is determined. These measurements are input to control block 72 which calculates the position of the object 28 relative to the gyroscope. Once the position of the object 28 relative to the gyroscope is determined, control passes to block 74 which generates control commands for aligning the gyroscope 38 so that the gyroscope axis 40 is aligned with the line of sight 32. Control then passes to block 76 which generates control commands in accordance with the position of the gyroscope relative to the platform from block 78. At block 76, the camera or platform 34 is then displaced so that the platform axis 26 is aligned coincident with the line of sight 32. Further, note that control commands output by block 74 can also be used to provide estimate rates of target motion, as will be described further herein.

One benefit that may be realized from this approach can be seen with reference to present image processing techniques for tracking the motion of the object or target 28 across the camera 34. Present systems typically have difficulty accurately measuring partial pixel motion for small, dim objects. Measurements for subpixel motions tend to be non-linear. The present invention improves distinguishing partial pixel motion as can be seen with reference to FIG. 4. In FIG. 4, block 65 represents a dithering function, shown in phantom, which alters the preferred orientation of the platform into the stability loop transfer function block 62. By introducing the dithering function into the stabilization control loop 60, the preferred orientation of the platform is varied. This randomizes the subpixel portions of the target position, reducing measurement errors to white noise. This noise is not correlated to the target position and facilitates distinguishing partial pixel motion for small, dim targets.

An other important benefit of control systems 46 and 66 is that designers can significantly reduce platform control requirements for the purposes of guidance. Where sensitivity requirements can be relaxed, designers are limited by measurement accuracy, not by control accuracy. Relaxed platform requirements can be achieved by enhancing the tracker interface. Filters inside the tracker, rather than within the control systems 46 and 66, often assume that the target is maintained in the middle of the field of view (FOV) by the control loop or that the object moves across the field of view according to the rate commanded by the tracking loop 56. The tracker filters requires stable platforms in order to yield such information. By relying on the gyroscope case angle to determine the expected position of the object within the FOV platform stabilization requirements may be relaxed because the tracker filters do not provide FOV information. This effectively decouples the tracker from the platform.

Further, this approach may be expanded beyond controlling the camera system 12 to track an object 28. This information may be used to estimate the LOS rate of the motion of the object 28. The gyroscope pointing error is used to derive the LOS rate estimate. For example, with reference to FIG. 5, block 74 may also provide an estimate on the target LOS rate. By using gyroscope referenced measurements, rather than platform reference measurements, significant improvements for estimating rates of target motion can be realized. Target motion is sometimes estimated by integrating gyroscopic commands, and a head rate correction, which provides the difference between the gyroscope and the platform rate, is applied. The correction is derived from the gyroscope case angle. By using the slaved reference approach described herein, the head rate correction term can be omitted by relying upon the gyroscopic referenced pointing errors. The case angle input then becomes a static correction added at the start and end of the interval, but is not integrated, thereby reducing noise accumulation. Further, by using gyroscope based pointing error as described herein, the platform disturbance terms are not separated. The terms are collected together and added before input to the estimation filters so that the errors on each term cancel.

From the foregoing, it can seen that the slaved referenced control described herein significantly reduces platform disturbances and body motion coupling into the determination of LOS rate estimates. By aligning the gyroscope 38 with the object 28 then aligning the camera or platform 34 with the gyroscope 38, a significant improvement in controlling the estimated LOS rate results. This effectively decouples the tracking loop from the stabilization loop and the control algorithm for estimating the LOS rate.

Although the invention has been described with particular reference to certain preferred embodiments thereof, variations and modifications can be effected within the spirit and scope of the following claims.

What is claimed is:

1. An apparatus for enabling a projectile to track an object, comprising:

a body generally defined as the projectile;

a platform attached to the body and including a tracking device, the platform being movably attached to the body so that the body and platform move relative to each other;

a gyroscope attached to the platform, the gyroscope being attached to the platform to enable relative movement between the gyroscope and the platform; and a controller for generating control commands to displace the gyroscope and the platform in order to track the object, where the gyroscope is first displaced to track the object and the platform is then displaced to align the platform to the gyroscope.

2. The apparatus as defined in claim 1 wherein the controller uses closed loop control to position the gyroscope and the platform and includes a tracking loop to position the gyroscope and a stabilization loop to position the platform.

3. The apparatus as defined in claim 1 wherein the control commands generated by the controller displace the gyroscope to a preferred orientation with respect to the object, and the control commands generated by the controller displace the platform to a preferred orientation with respect to the gyroscope.

4. The apparatus as defined in claim 3 wherein the controller determines a position of the object relative to the preferred orientation of the gyroscope to generate the control commands.

5. The apparatus as defined in claim 3 wherein the controller outputs a gyroscope rate command to minimize an angle between the object and the preferred orientation of the gyroscope.

6. The apparatus as defined in claim 1 wherein the gyroscope is housed in a case rigidly attached to the platform so that the gyroscope moves relative to the case and the platform.

7. A projectile, comprising:

means for propulsion; and an apparatus for tracking an object moving relative to the projectile, including:

a body generally defined as a housing for the projectile;

a platform attached to the body and including a tracking device, the platform being movably attached to the body so that the body and platform move relative to each other;

a gyroscope attached to the platform, the gyroscope being attached to the platform to enable relative movement between the gyroscope and the platform; and a controller for generating control commands to displace the gyroscope and the platform in order to track the object, where the gyroscope is first displaced to track the object and the platform is then displaced to align the platform to the gyroscope.

8. The projectile as defined in claim 7 wherein the controller uses closed loop control to position the gyroscope and the platform and includes a tracking loop to position the gyroscope and a stabilization loop to position the platform.

9. The projectile as defined in claim 7 wherein the control commands generated by the controller displace the gyroscope to a preferred orientation with respect to the object, and the control commands generated by the controller displace the platform to a preferred orientation with respect to the gyroscope.

10. The projectile as defined in claim 9 wherein the controller determines a position of the object relative to the preferred orientation of the gyroscope to generate the control commands.

11. The projectile as defined in claim 9 wherein the controller outputs a gyroscope command to minimize an angle between the object and the preferred orientation of the gyroscope.

12. The projectile as defined in claim 7 wherein the gyroscope is housed in a case rigidly attached to the platform so that the gyroscope moves relative to the case and the platform.

13. The projectile as defined in claim 7 wherein the control commands output by the control define a gyroscope based pointing error.

14. The projectile as defined in claim 13 wherein the gyroscope based pointing error is defined as a line of sight between the gyroscope and the object.

15. A method for controlling a camera mounted on a body of a projectile, comprising the steps of:

providing a gyroscope attached to the camera and displaceable in at least two degrees of freedom relative to the camera;

locating an object within a field of view of an image output by the camera;

determining a displacement of the gyroscope relative to the object;

determining a displacement of the object in relation to a center of the field of view, providing a position of the object relative to the camera;

generating command signals to displace the gyroscope to a predetermined orientation with respect to the object; and generating command signals to displace the camera to a predetermined orientation with respect to the gyroscope.

16. The method as defined in claim 15 wherein the step of generating command signals to displace the gyroscope includes a tracking loop which operates independently of disturbances to the camera.

17. The method as defined in claim 16 wherein the step of generating command signals to displace the gyroscope further comprises the step of utilizing a pointing error measurement defined as an angle between the object and the preferred orientation of the gyroscope.

18. The method as defined in claim 17 wherein the step of generating command signals to displace the platform includes a stabilization loop which operates independently of the orientation position of the gyroscope.

19. The method as defined in claim 18 wherein the step of determining a displacement of the gyroscope includes the step of determining the position of the object relative to the orientation of the gyroscope to generate the command signals.

20. The method as defined in claim 15 wherein the step of generating commands signals to displace the camera includes a stabilization loop.

21. The method as defined in claim 20 wherein a dithering signal is introduced into the stabilization loop in order to minimize the effect of measurement non-linearities.

22. An apparatus for tracking an object comprising;

a body;

a platform moveably attached to the body;

a camera for generating an image of the object;

a gyroscope displaceable in at least two degrees of freedom relative to the camera;

means for locating the object within a field of view of the image generated by the camera;

means for determining a displacement of the gyroscope relative to the object;

means for determining a displacement of the object in relation to a center of the field of view and for providing a position of the object relative to the camera; and controller means for generating command signals to displace the gyroscope to a predetermined orientation with respect to the object and for generating command signals to displace the camera to a predetermined orientation with respect to the gyroscope.

* * * * *